US006325069B1

(12) United States Patent
Heims

(10) Patent No.: US 6,325,069 B1
(45) Date of Patent: Dec. 4, 2001

(54) PEDICURE SYSTEM

(76) Inventor: Jules Heims, 3910 Shoreside Cir., Tampa, FL (US) 33624

( * ) Notice: Subject to any disclaimer, the term of this patent is extended or adjusted under 35 U.S.C. 154(b) by 0 days.

(21) Appl. No.: 09/542,271

(22) Filed: Apr. 4, 2000

(51) Int. Cl.[7] ..... A45D 29/00; A45D 29/18
(52) U.S. Cl. ..... 132/73; 132/73.5
(58) Field of Search ..... 132/73, 73.5, 75.6, 132/75.3, 76.4

(56) References Cited

U.S. PATENT DOCUMENTS

D. 162,870 * 4/1951 Pearce ..... 132/75.6
1,829,338 * 10/1931 Bynum ..... 132/76.4
2,479,514 * 8/1949 Rucker ..... 132/76.4
2,676,597 * 4/1954 Colbert ..... 132/73.5
3,131,701 * 5/1964 Emerson ..... 132/75.6
4,246,914 * 1/1981 Keyser ..... 132/76.4
5,816,266 * 10/1998 Cone ..... 132/76.4

* cited by examiner

*Primary Examiner*—John J. Wilson
*Assistant Examiner*—Robyn Kieu Doan

(57) ABSTRACT

A pedicure system includes a post having a handle at the proximal end and a file at the distal end. A foot support has a plate with a lower end and an upper end. The upper end is formed with a downwardly projecting plate to retain the plate at an angle. A toe support is formed as a generally U-shaped channel with a lower horizontal portion adjustably secured to the plate and upwardly extending parallel side portions to allow the toe support to be shifted from side to side.

4 Claims, 3 Drawing Sheets

FIG 3
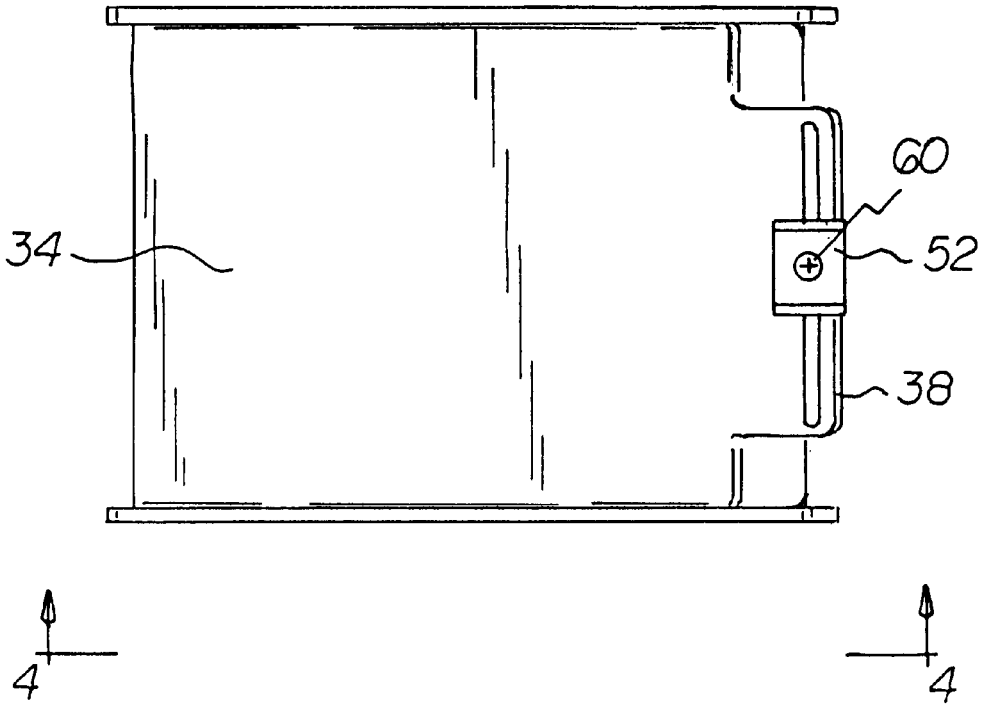
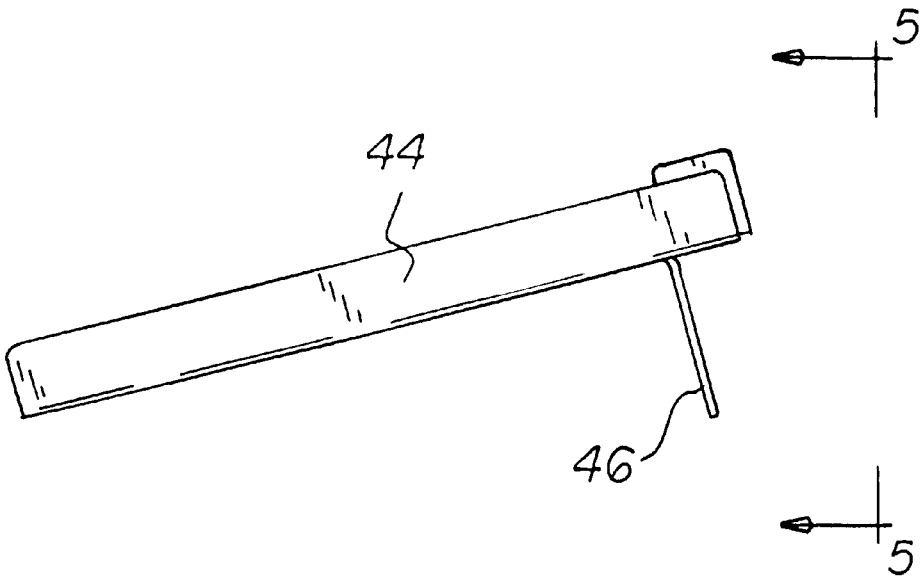
FIG 4

FIG 5
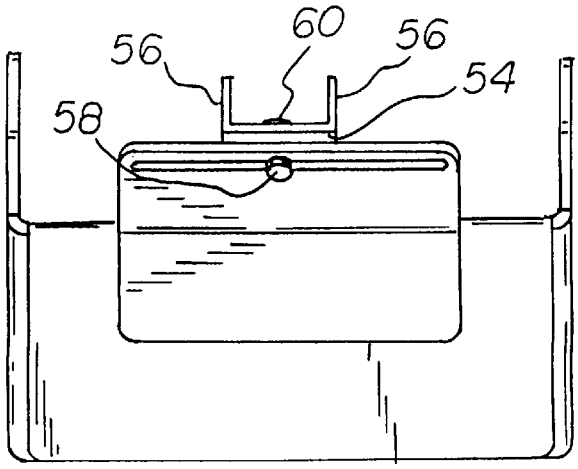
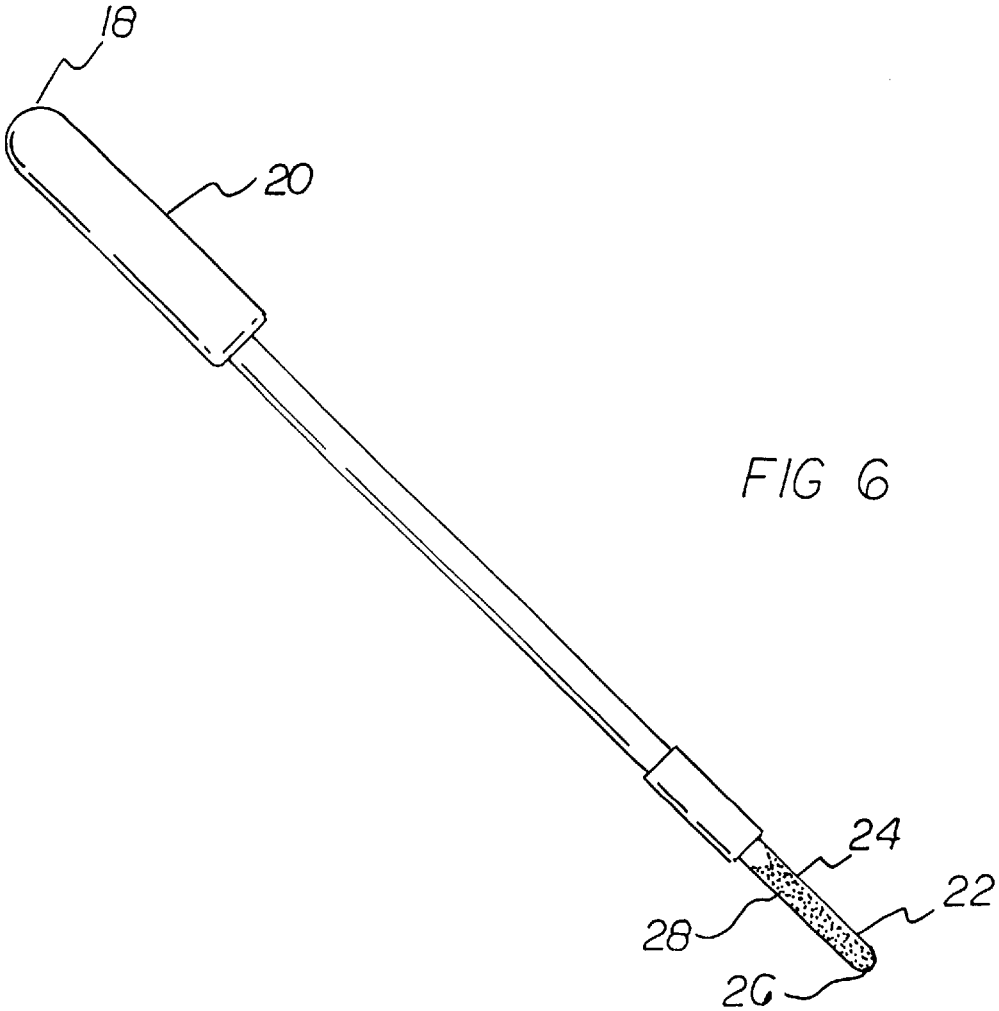
FIG 6

PEDICURE SYSTEM

BACKGROUND OF THE INVENTION

1. Field of the Invention

The present invention relates to a pedicure system and more particularly pertains to trimming one's own toenails in a safe and convenient manner.

2. Description of the Prior Art

The use of files for nails of known designs and configurations is known in the prior art. More specifically, files for nails of known designs and configurations previously devised and utilized for the purpose of trimming one's toenails through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,294,268 to Kitrell discloses a pedicure easel. U.S. Pat. No. 5,749,377 to Desario discloses a pedicure kit. Lastly, U. S. Pat. No. 5,775,340 to Rains discloses long handle toenail clippers.

While these devices fulfill their respective, particular objectives and requirements, the aforementioned patents do not describe a pedicure system that allows trimming one's own toenails in a safe and convenient manner.

In this respect, the pedicure system according to the present invention substantially departs from the conventional concepts and designs of the prior art, and in doing so provides an apparatus primarily developed for the purpose of trimming one's own toenails in a safe and convenient manner.

Therefore, it can be appreciated that there exists a continuing need for a new and improved pedicure system which can be used for trimming one's own toenails in a safe and convenient manner. In this regard, the present invention substantially fulfills this need.

SUMMARY OF THE INVENTION

In view of the foregoing disadvantages inherent in the known types of files for nails of known designs and configurations now present in the prior art, the present invention provides an improved pedicure system. As such, the general purpose of the present invention, which will be described subsequently in greater detail, is to provide a new and improved pedicure system and method which has all the advantages of the prior art and none of the disadvantages.

To attain this, the present invention essentially comprises a cylindrical post. The post has a distal end and a proximal end. The post is formed with a handle at the proximal end for being grasped by a user. The distal end is formed with a file. The file has a cylindrical major extent with a hemispherical end remote from the handle. The file is formed with an abrasive surface essentially over its entire extent for contacting and filing away unwanted areas including toenails, corns, and callouses of a user when placed adjacent to the appropriate unwanted area of a user. In operation and use, the handle is grasped and reciprocated by a user to reciprocate the abrasive surface against such unwanted area. A foot support is next provided. The foot support has a plate in a generally rectangular configuration. The plate has a lower end which, in operation and use, is positioned upon a recipient surface, such as a floor. The plate also has an upper end. The upper end has a forwardly extending rectangular region and parallel side edges there between. The side edges are formed with upstanding ledges to confine the foot against lateral motion during operation and use. The upper end is formed with a downwardly projecting plate to retain the plate at an angle of about 15 degrees with respect to the horizontal. The rectangular region is formed with a slot transverse to the side edges. Lastly, a toe support is provided. The toe support functions as a positioner and also as a file guide so the file will not slip off of the nail. The toe support is formed as a generally U-shaped channel with a lower horizontal portion and upwardly extending parallel side portions parallel with the ledges of the plate. A bolt is provided. The bolt extends through the horizontal portion and the slot and is cooperable with a nut for tightening purposes and to allow the toe support to be shifted from side to side for thereby receiving any one of the user's toes. In this manner the received toe is retained in proper position spaced from adjacent toes when the user reciprocates the handle to move the abrasive surface into contact with the unwanted area of the toe located within the U-shaped member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pedicure system which has all of the advantages of the prior art files for nails of known designs and configurations and none of the disadvantages.

It is another object of the present invention to provide a new and improved pedicure system which may be easily and efficiently manufactured and marketed.

It is a further object of the present invention to provide a new and improved pedicure system which is of durable and reliable constructions.

An even further object of the present invention is to provide a new and improved pedicure system which is susceptible of a low cost of manufacture with regard to both materials and labor, and which accordingly is then susceptible of low prices of sale to the consuming public, thereby making such pedicure system economically available to the buying public.

Even still another object of the present invention is to provide a pedicure system for trimming one's own toenails in a safe, convenient and comfortable manner.

Lastly, it is an object of the present invention to provide a new and improved pedicure system which includes a post having a handle at the proximal end and a file at the distal end. A foot support has a plate with a lower end and an upper end. The upper end is formed with a downwardly projecting plate to retain the plate at an angle. A toe support is formed as a generally U-shaped channel with a lower horizontal portion adjustably secured to the plate and upwardly extending parallel side portions to allow the toe support to be shifted from side to side.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view of the foot support shown in FIG. 2.

FIG. 4 is a side elevational view taken along line 4—4 of FIG. 3.

FIG. 5 is an end elevational view taken along line 5—5 of FIG. 4.

FIG. 6 is a side elevational view of the post, handle, and file as shown in FIG. 1.

The same reference numerals refer to the same parts throughout the various Figures.

DESCRIPTION OF THE PREFERRED EMBODIMENT

Figures 1, 2:
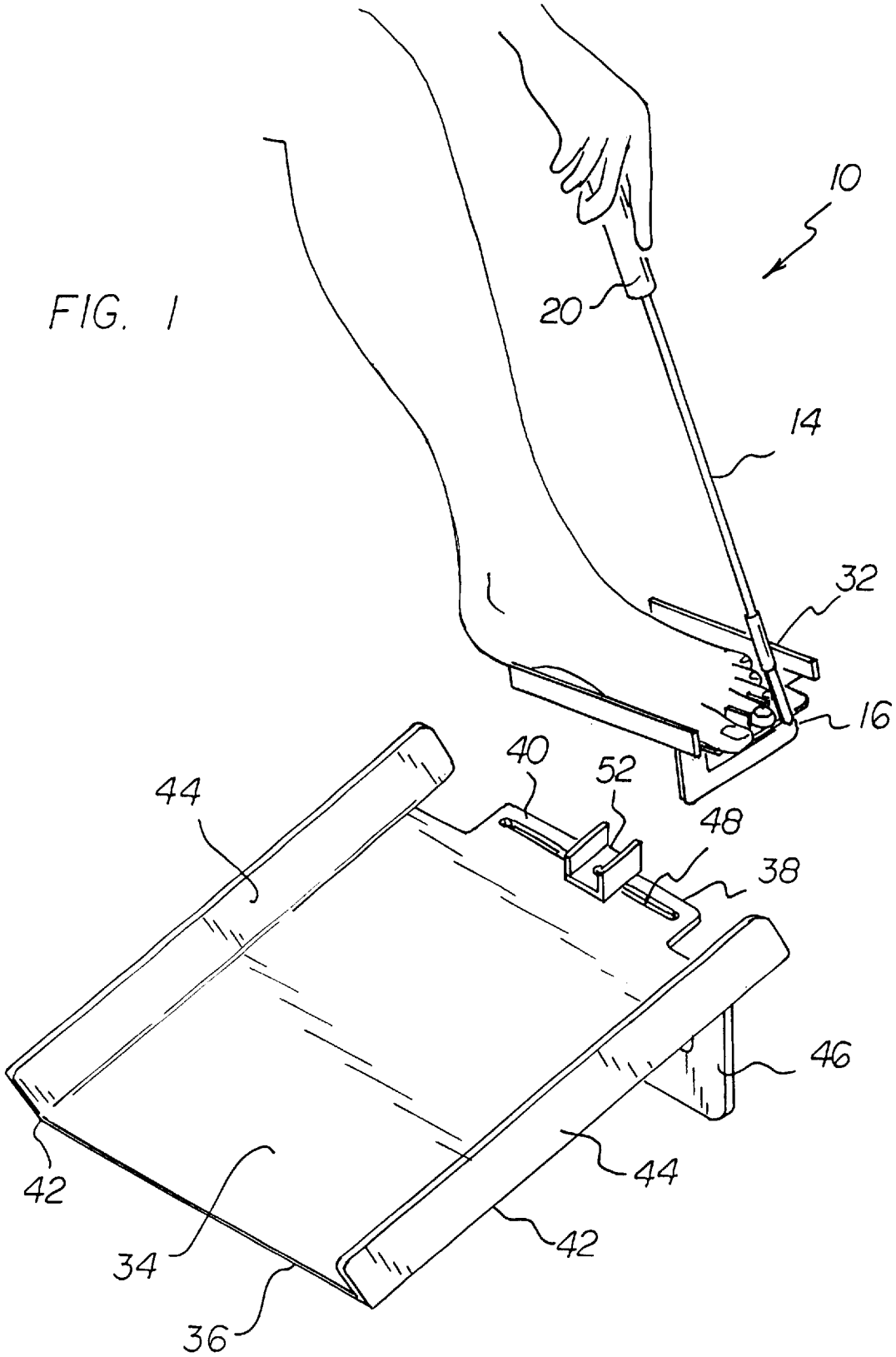
FIG. 1 is a perspective view of the new and improved pedicure system constructed in accordance with the principles of the present invention.
FIG. 2 is an enlarged perspective illustration of the foot support shown in FIG. 1.

With reference now to the drawings, and in particular to FIG. 1 thereof, the preferred embodiment of the new and improved pedicure system embodying the principles and concepts of the present invention and generally designated by the reference numeral 10 will be described.

The present invention, the pedicure system 10 is comprised of a plurality of components. Such components in their broadest context include a post, a foot support, and a toe support. Such components are individually configured and correlated with respect to each other so as to attain the desired objective. A cylindrical post 14 is first provided. The post has a distal end 16 and a proximal end 18. The post is formed with a handle 20 at the proximal end for being grasped by a user. The distal end is formed with a file 22. The file has a cylindrical major extent 24 with a hemispherical end 26 remote from the handle. The file is formed with an abrasive surface 28 essentially over its entire extent for contacting and filing away unwanted areas including toenails, corns, and callouses of a user when placed adjacent the appropriate unwanted area of a user. In operation and use, the handle is grasped and reciprocated by a user to reciprocate the abrasive surface against such unwanted area.

A foot support 32 is next provided. The foot support has a plate 34 in a generally rectangular configuration. The plate has a lower end 36 which, in operation and use, is positioned upon a recipient surface, such as a floor. The plate also has an upper end 38. The upper end has a forwardly extending rectangular region 40 and parallel side edges there between. The side edges 42 are formed with upstanding ledges 44 to confine the foot against lateral motion during operation and use. The upper end is formed with a downwardly projecting plate 46 to retain the plate at an angle of about 15 degrees with respect to the horizontal. The rectangular region is formed with a slot 48 transverse to the side edges.

Lastly, a toe support 52 is provided. The toe support functions as a positioner and file guide so the file does not slip off of the nail. The toe support is formed as a generally U-shaped channel with a lower horizontal portion 54 and upwardly extending parallel side portions 56 parallel with the ledges of the plate. A bolt 58 is provided. The bolt extends through the horizontal portion and the slot and is cooperable with a nut 60 for tightening purposes and to allow the toe support to be shifted from side to side for thereby receiving any one of the user's toes. In this manner the received toe is retained in proper position spaced from adjacent toes when the user reciprocates the handle to move the abrasive surface into contact with the unwanted area of the toe located within the U-shaped member.

It should be understood that the primary use for most individuals utilizing the system of the present invention will be for filing toenails in a manner which is safe and which is also convenient for people having difficulty to bend fully, as through age or weight restrictions. It should, likewise, be understood that in addition to toenails, the file could readily be used for filing other unwanted areas on or about the foot of a user including, callouses and corns, as well as the nails at the top and ends of the toes with such filing being done in a more safe and convenient and comfortable manner to all users. Another aspect of the invention is in the utilization of the file for removing dead skin from the bottom of heels as well as callouses from the balls of feet and behind the heels of a user. Lastly, the file portion of the present invention could, of course, be used as a regular file to file nails including fingernails of one's hands as well as callouses on one's hands by simply holding onto the post at a central extent closer to the distal end rather than holding it by the handle as used in the primary embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved pedicure system for trimming one's own toenails in a safe and convenient manner, comprising, in combination:

a cylindrical post having a distal end and a proximal end, the post being formed with a handle at the proximal end for being grasped by a user, the distal end being formed with a file having a cylindrical major extent with a hemispherical end remote from the handle, the file being formed with an abrasive surface essentially over its entire extent for contacting and filing away unwanted areas including toenails, corns, and callouses of a user when placed adjacent the appropriate unwanted area of a user and with the handle grasped and reciprocated by a user to reciprocate the abrasive surface against such unwanted area;

a foot support with a plate in a generally rectangular configuration having a lower end positioned upon a recipient surface, such as a floor, and an upper end having a forwardly extending rectangular region and having parallel side edges there between, the side edges being formed with upstanding ledges to confine the foot against lateral motion during operation and use, the upper end being formed with a downwardly projecting plate to retain the plate at an angle of about 15 degrees with respect to the horizontal and with the rectangular region being formed with a slot transverse to the side edges; and a toe support functioning as a positioner formed as a generally U-shaped channel with a lower horizontal portion and upwardly extending parallel side portions parallel with the ledges of the plate, with a bolt extending through the horizontal portion and the slot and cooperable with a nut for tightening purposes and to allow the toe support to be shifted from side to side for thereby receiving any one of the user's toes to retain the received toe in proper position spaced from adjacent toes when the user reciprocates the handle to move the abrasive surface into contact with the unwanted area of the toe located within the U-shaped member.

2. A pedicure system comprising:

a post having a handle at the proximal end and a file at the distal end;

a foot support with a plate having a lower end and an upper end and a transverse slot therebetween, the upper end being formed with a downwardly projecting plate to retain the plate at an angle; and a toe support formed as a generally U-shaped channel with a lower horizontal portion adjustably secured to the plate and upwardly extending parallel side portions to allow the toe support to be shifted from side to side.

3. The system as set forth in claim 2 and further including a pair of parallel side ledges extending upwardly from the side edges of the plate.

4. The system as set forth in claim 2 wherein the file is in a generally cylindrical configuration with a hemispherical end remote from the handle.

* * * * *